US009115858B2

(12) United States Patent
Levante et al.

(10) Patent No.: US 9,115,858 B2
(45) Date of Patent: Aug. 25, 2015

(54) EXTENDED LENGTH FLEXIBLE LED LIGHT STRIP SYSTEM

(71) Applicant: Inspired LED, LLC, Tempe, AZ (US)

(72) Inventors: James J. Levante, Tempe, AZ (US); Tanner J. Leland, Tempe, AZ (US)

(73) Assignee: Inspired LED, LLC, Tempe, AZ (US)

( * ) Notice: Subject to any disclaimer, the term of this patent is extended or adjusted under 35 U.S.C. 154(b) by 126 days.

(21) Appl. No.: 13/890,562

(22) Filed: May 9, 2013

(65) Prior Publication Data

US 2014/0334142 A1 Nov. 13, 2014

(51) Int. Cl.

| | |
|---|---|
| ***F21V 21/00*** | (2006.01) |
| ***F21S 4/00*** | (2006.01) |
| ***F21V 23/06*** | (2006.01) |
| *F21S 2/00* | (2006.01) |
| *F21Y 101/02* | (2006.01) |
| *F21Y 103/00* | (2006.01) |

(52) U.S. Cl.

CPC ..... *F21S 4/005* (2013.01); *F21V 23/06* (2013.01); *F21S 2/00* (2013.01); *F21Y 2101/02* (2013.01); *F21Y 2103/003* (2013.01)

(58) Field of Classification Search

CPC ..... F21V 23/06; F21S 2/00; F21Y 2101/02; F21Y 2103/003

USPC ..... 362/249.03, 249.11, 249.04

See application file for complete search history.

(56) References Cited

U.S. PATENT DOCUMENTS

| | | | | |
|---|---|---|---|---|
| 4,439,818 | A * | 3/1984 | Scheib | 362/249.06 |
| 4,597,033 | A * | 6/1986 | Meggs et al. | 362/183 |
| 6,673,293 | B1 * | 1/2004 | Mistopoulos et al. | 264/149 |
| 6,866,398 | B2 * | 3/2005 | Lin | 362/249.04 |
| 7,051,464 | B2 * | 5/2006 | Kwon | 40/550 |
| 8,215,786 | B2 * | 7/2012 | Sloan et al. | 362/145 |
| 8,262,250 | B2 * | 9/2012 | Li et al. | 362/219 |
| 8,322,883 | B2 * | 12/2012 | Cleaver et al. | 362/249.04 |
| 8,511,849 | B2 * | 8/2013 | Sloan et al. | 362/224 |
| 8,517,759 | B1 * | 8/2013 | Brown | 439/492 |
| 2004/0037080 | A1 * | 2/2004 | Luk et al. | 362/252 |
| 2010/0039813 | A1 * | 2/2010 | Sloan et al. | 362/246 |
| 2013/0027976 | A1 * | 1/2013 | Robbins et al. | 362/612 |

OTHER PUBLICATIONS www.xtremeledsonline.com/store/pages.php?pageid=94; Webpage from Xtreme LEDs Online.Com; Received and Printed on Apr. 29, 2013.

www.ledworldlighting.com/ledborder.html; Webpage from LED World Lighting; Received and Printed on Apr. 29, 2013.

www.americanlighting.com/products.cfm?ID=139; Webpage from American Lighting Products; Received and Printed on Apr. 29, 2013.

(Continued)

*Primary Examiner* — Ali Alavi

(74) *Attorney, Agent, or Firm* — Michael S. Neustel

(57) ABSTRACT

An extended length flexible LED light strip system for extending the length of a flexible LED light strip. The extended length flexible LED light strip system generally includes a protective covering having a passage, a light strip extending within the passage of the protective covering, a first power bus and a second power bus within the protective covering, and a plurality of connectors electrically connecting the light strip to the power buses at selected lengths. A power coupler is provided that includes a pair of prongs that extend into the protective covering and electrically contact the power buses to provide DC power to the power buses.

21 Claims, 18 Drawing Sheets

(56) References Cited

OTHER PUBLICATIONS www.socallighting.com/product.php?Screen=PROD&Store_Code=SL&Product_Code=SRRLED-12V-White; Webpage from So Cal Lighting; Received and Printed on Apr. 29, 2013.

www.superbrightleds.com/moreinfo/flexible-strips-and-bars/se-wfls-x60-series-60-high-power-led-waterproof-flexible-light-strip/103/; Webpage from Super Bright LEDs; Apr. 29, 2013.

PDF converted website of www.ledworldlighting.com (converted on Nov. 20, 2014 from Archive.org); LED Ribbon Flex Light (PVC), Published at least by May 3, 2012.

PDF converted website of www.ledworldlighting.com (converted on Nov. 20, 2014); LED Duraflex Tape Light: Border Light Series, date of publication unknown.

Screencaptured website of www.Alibaba.com (captured on Nov. 26, 2014); Shenzhen Better Technology Limited 120V LED Light Strip, Technology published at least by 2012.

* cited by examiner

EXTENDED LENGTH FLEXIBLE LED LIGHT STRIP SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a flexible LED light strip and more specifically it relates to an extended length flexible LED light strip system for extending the length of a flexible LED light strip.

2. Description of the Related Art Any discussion of the related art throughout the specification should in no way be considered as an admission that such related art is widely known or forms part of common general knowledge in the field.

Light strips, such as flexible LED light strips, have become increasingly popular in various applications such as but not limited to under cabinet lighting, TV back lighting, staircase lighting, architectural lighting, bar lighting, kitchen lighting, toe kick lighting, ceiling cove lighting, decorations and vehicles. A flexible LED light strip is comprised of an elongated flexible strip of printed circuit board (PCB) having two or more electrically conductive traces to provide electrical power, a plurality of light-emitting diodes (LED) attached along the front surface of the flexible strip and electrically connected to the conductive traces, and a length of adhesive along the back surface of the flexible strip. The LEDs may emit the same light or may change colors to provide a range of light options. Most conventional flexible LED light strips utilize a low-voltage 12V DC electrical power. During installation of flexible LED light strips, at least one end of the flexible LED light strip is physically and electrically connected to a connector (e.g. DC power coupler, splice connector, etc.). The end of the flexible LED light strip may be attached by soldering the LED light strip to the connector.

One problem with convention flexible LED light strips is that the traces are limited in width and thickness thereby resulting in significant voltage drop along the traces. The voltage drop along the traces limits the total usable length of the flexible LED light strips to approximately 35 feet in length thereby requiring additional power sources to be added for additional flexible LED lights strips where lighting requirements exceed 35 feet. In addition, installing conventional flexible LED light strips is time consuming because of the required soldering of the ends of the flexible LED light strips to a DC power source. Because of the inherent problems with the related art, there is a need for a new and improved extended length flexible LED light strip system for extending the length of a flexible LED light strip.

BRIEF SUMMARY OF THE INVENTION

The invention generally relates to a flexible LED light strip which includes a protective covering having a passage, a light strip extending within the passage of the protective covering, a first power bus and a second power bus within the protective covering, and a plurality of connectors electrically connecting the light strip to the power buses at selected lengths. A power coupler is provided that includes a pair of prongs that extend into the protective covering and electrically contact the power buses to provide DC power to the power buses.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
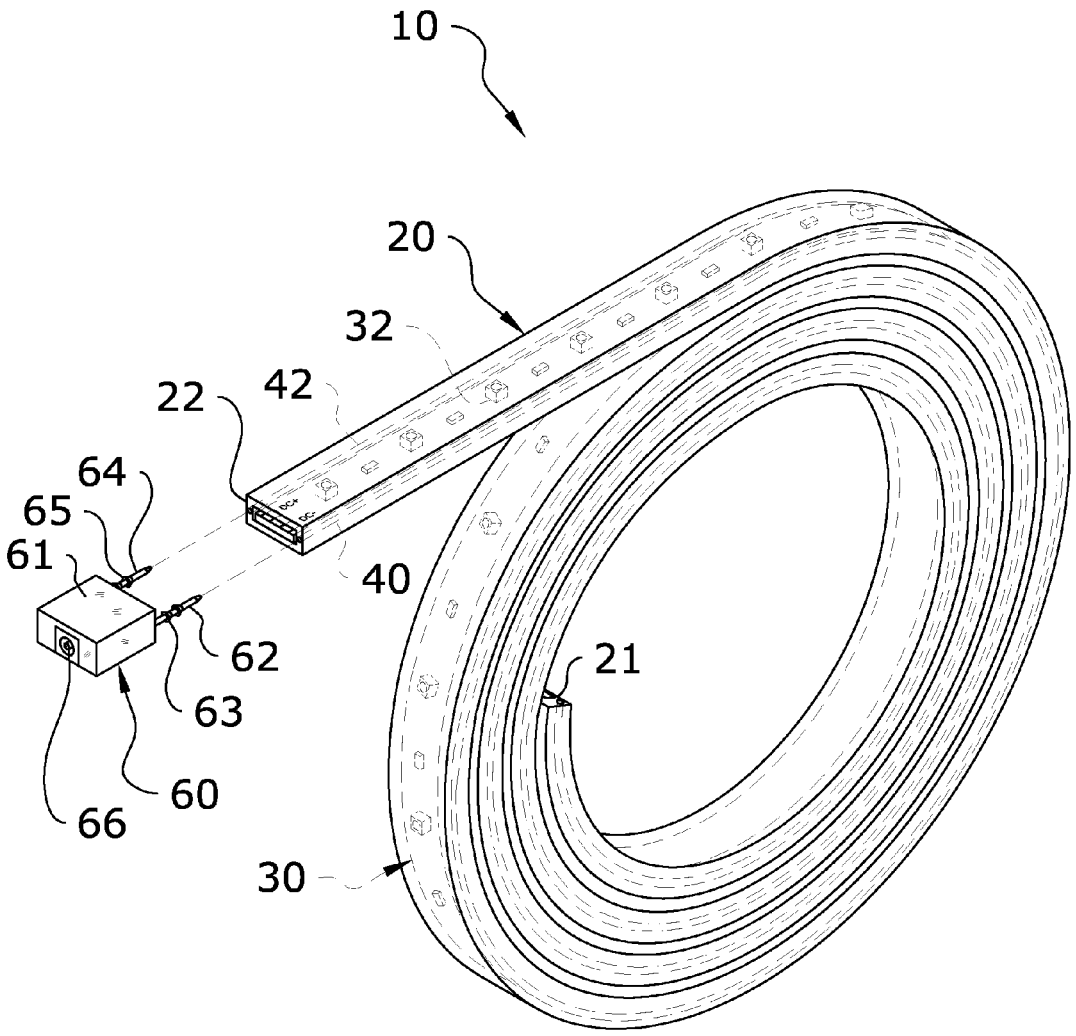
FIG. 1 is an upper perspective view of the present invention rolled up for dispensing a desired length.

Turning now descriptively to the drawings, in which similar reference characters denote similar elements throughout the several views, FIGS. 1 through 18 illustrate an extended length flexible LED light strip system 10, which comprises a protective covering 20 having a passage 24, a light strip 30 extending within the passage 24 of the protective covering 20, a first power bus 40 and a second power bus 42 within the protective covering 20, and a plurality of connectors electrically connecting the light strip 30 to the power buses 40, 42, 44, 46 at selected lengths. A power coupler 60 is provided that includes a pair of prongs 62, 64, 67, 68 that extend into the protective covering 20 and electrically contact the power buses 40, 42, 44, 46 to provide DC power to the power buses 40, 42, 44, 46. The flexible LED light strip 30 and the protective covering 20 are preferably at least 40 feet in length but may have lengths less than 40 feet. The flexible LED light strip 30 may have various widths which are well known in the art.

B. Light Strip

FIGS. 2 through 8*b* illustrate an exemplary light strip 30 that is positioned within the protective covering 20. The light strip 30 emits light preferably from only one side of the light strip 30, but may emit light in multiple directions. The light strip 30 includes a plurality of light units 32 that emit light when electrical power is distributed to the light strip 30. The light units 32 may be equidistantly spaced apart or spaced apart at different intervals. The light strip 30 is electrically powered preferably by DC voltage. The DC voltage required to illuminate the light units 32 on the light strip 30 may range from 5V DC to 48V DC (e.g. 12V DC, 24V DC).

As further shown in FIGS. 2 through 8*b*, the light strip 30 is preferably comprised of a flexible LED light strip 30 having an elongated base 31 with the light units 32 comprised of light emitting diodes (LEDs). The elongated base 31 is comprised of a flat, flexible non-conductive substrate that has two or more electrically conductive traces within the substrate such as a flexible strip of printed circuit board (PCB) or printed wiring board (PWB). The non-conductive substrate strip is preferably less than 1 mm in thickness. U.S. Pat. No. 8,262,250 to Lie et al. illustrates an exemplary flexible LED light strip 30 suitable for usage within the present invention and is hereby incorporated by reference herein. The elongated base 31 of the light strip 30 is comprised of a material that allows an individual to cut both the light strip 30 and the surrounding protective covering 20 to a desired length (e.g. 9 feet, 30 feet, 45 feet, 50 feet, 55 feet and the like).

The traces within the elongated base 31 extend along an entire length of the light strip 30. The traces are electrically connected to the light units 32 to provide electrical power to the light units 32. For example, for a single color light strip 30, only a first trace and a second trace are required to provide the electrical power needed to illuminate the light units 32. If multiple colors are to be emitted by the light strip 30, then a third trace and a fourth trace are included within the elongated base 31 of the light strip 30 to provide selective electrical power to the traces to create the desired color.

Figure 6:
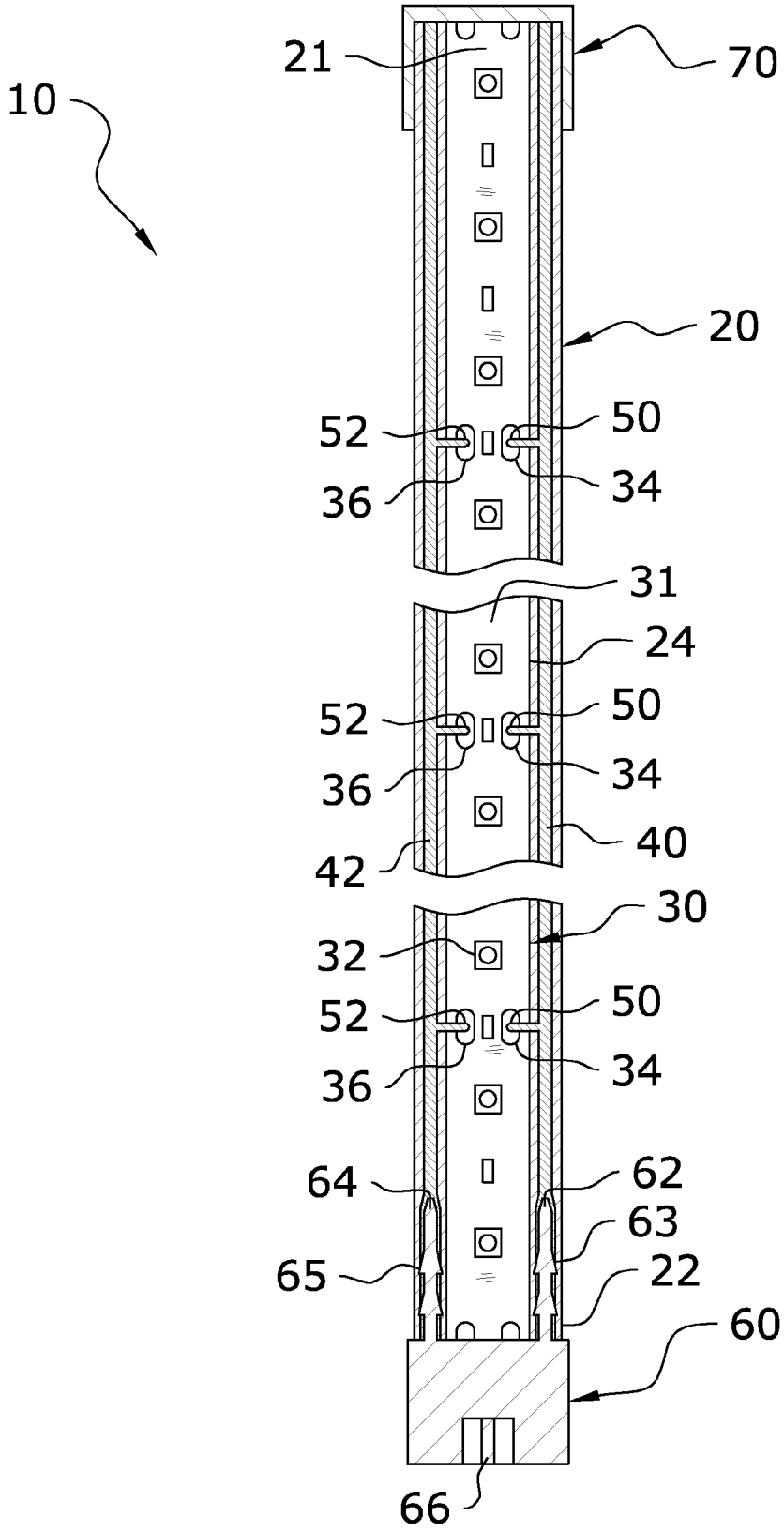
FIG. 6 is a partial cutaway top view of the present invention.
Figure 7:
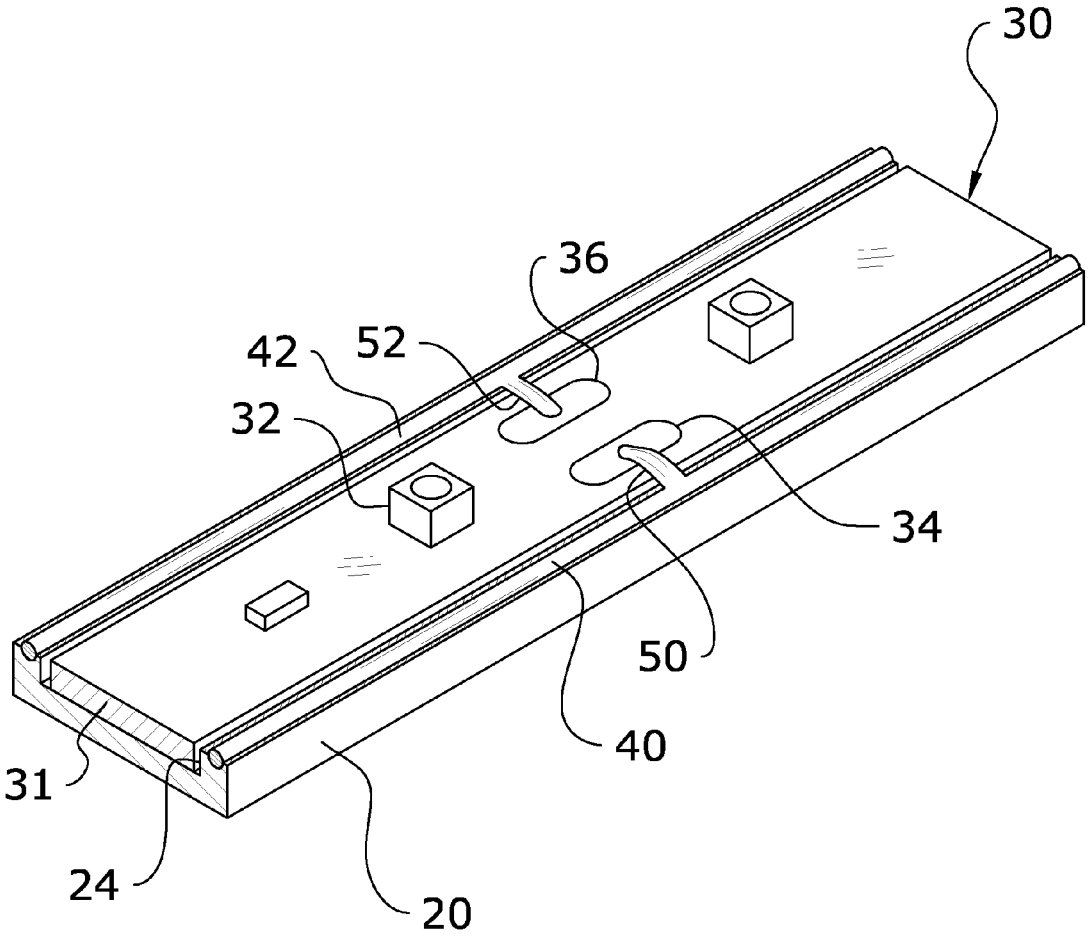
FIG. 7 is a partial cutaway upper perspective view of the present invention.

One or both of the ends of the light strip 30 may include electrical connectors for electrically connecting to an external device (e.g. power unit). In addition, the light strip 30 includes a plurality of first contacts 34 and a plurality of second contacts 36 that are electrically connected to the first trace and the second trace respectively along the length of the light strip 30 (e.g. every 6 inches). The first contacts 34 and the second contacts 36 are attached to a first surface of the elongated base 31 as best illustrated in FIG. 6 of the drawings. If a third trace and a fourth trace are within the light strip 30, then a plurality of third contacts 37 and a plurality of fourth contacts 38 are attached to the first surface of the elongated base 31 and electrically connected respectively to the third trace and the fourth trace.

C. Protective Covering

FIGS. 1 through 8 best illustrate the protective covering 20 that surrounds the light strip 30 to protect the light strip 30. The protective covering 20 has a first end 22 and a second end 21 opposite of the first end 22. The protective covering 20 is flexible and allows light from the light units 32 to pass through. The flexibility of the protective covering 20 allows for the protective covering 20 and the light strip 30 to conform around irregular surfaces.

The protective covering 20 is transparent or semi-transparent to allow the light from the light units 32 to pass through the protective covering 20 and to illuminate a surrounding area. The protective covering 20 may have various cross sectional shapes such as but not limited to rectangular, square, triangular, circular, oval, polygonal and the like.

Figure 8A:
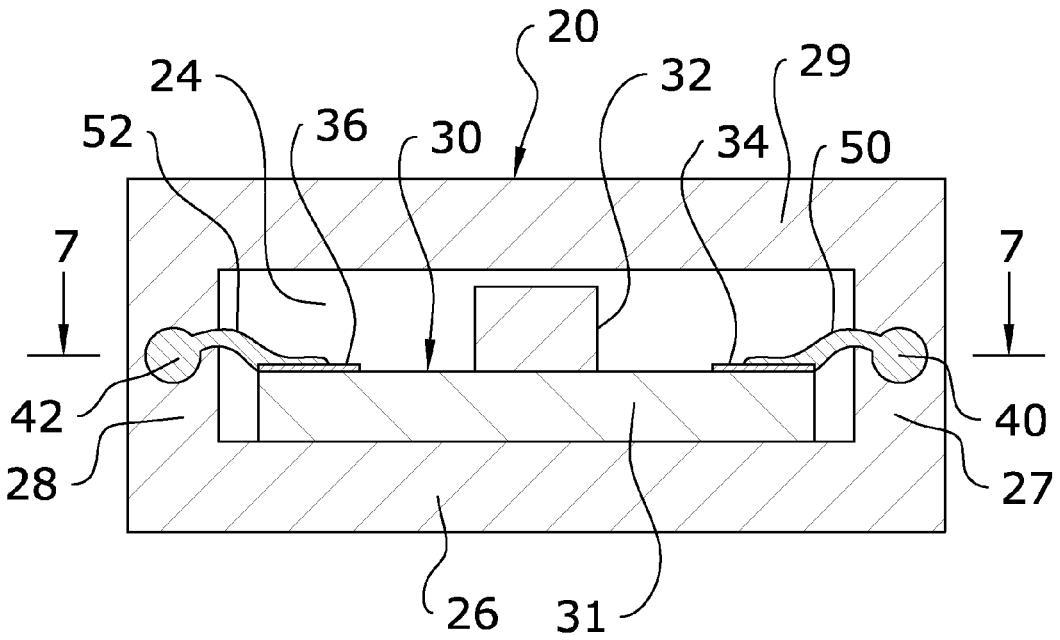
FIG. 8*a* is a cross sectional view taken along line 8-8 of FIG. 3 showing the protective covering with a passage that receives the light strip.
Figure 8B:
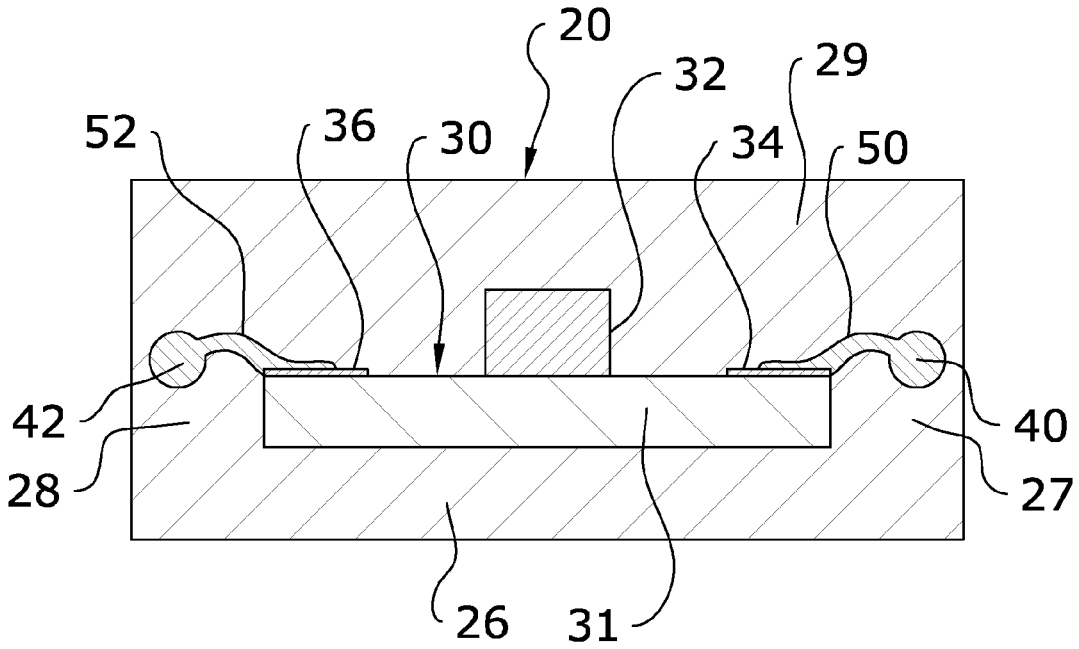
FIG. 8*b* is a cross sectional view showing the protective covering comprised of a material encasing the light strip without a passage.

The protective covering 20 is preferably waterproof to prevent water from making contact with the light strip 30. The protective covering 20 may be comprised of a tubular structure having a passage 24 such as a sleeve constructed of silicone, polyurethane or plastic tubular structure as shown in FIG. 8*a* or non-tubular structure that encases the light strip 30 without a passage 24 constructed of epoxy, polyurethane or silicone encasing the light strip 30 as shown in FIG. 8*b*. The advantage of encasing the light strip 30 with the protective covering 20 is that a puncture or fracture in one location will not allow water to pass through the remaining portions of the light strip 30.

The preferred embodiment of the protective covering 20 has a rectangular cross section having a base portion 26, a first sidewall 27 extending from a first side of the base portion 26, a second sidewall 28 extending from the second side of the base portion 26 and an outer portion 29 extending between the distal ends of the sidewalls 27, 28 to form the passage 24 as illustrated in FIGS. 8*a* and 8*b* of the drawings. The passage 24 extends longitudinally along the entire length of the protective covering 20 to receive the light strip 30 positioned within the protective covering 20.

Figure 2:
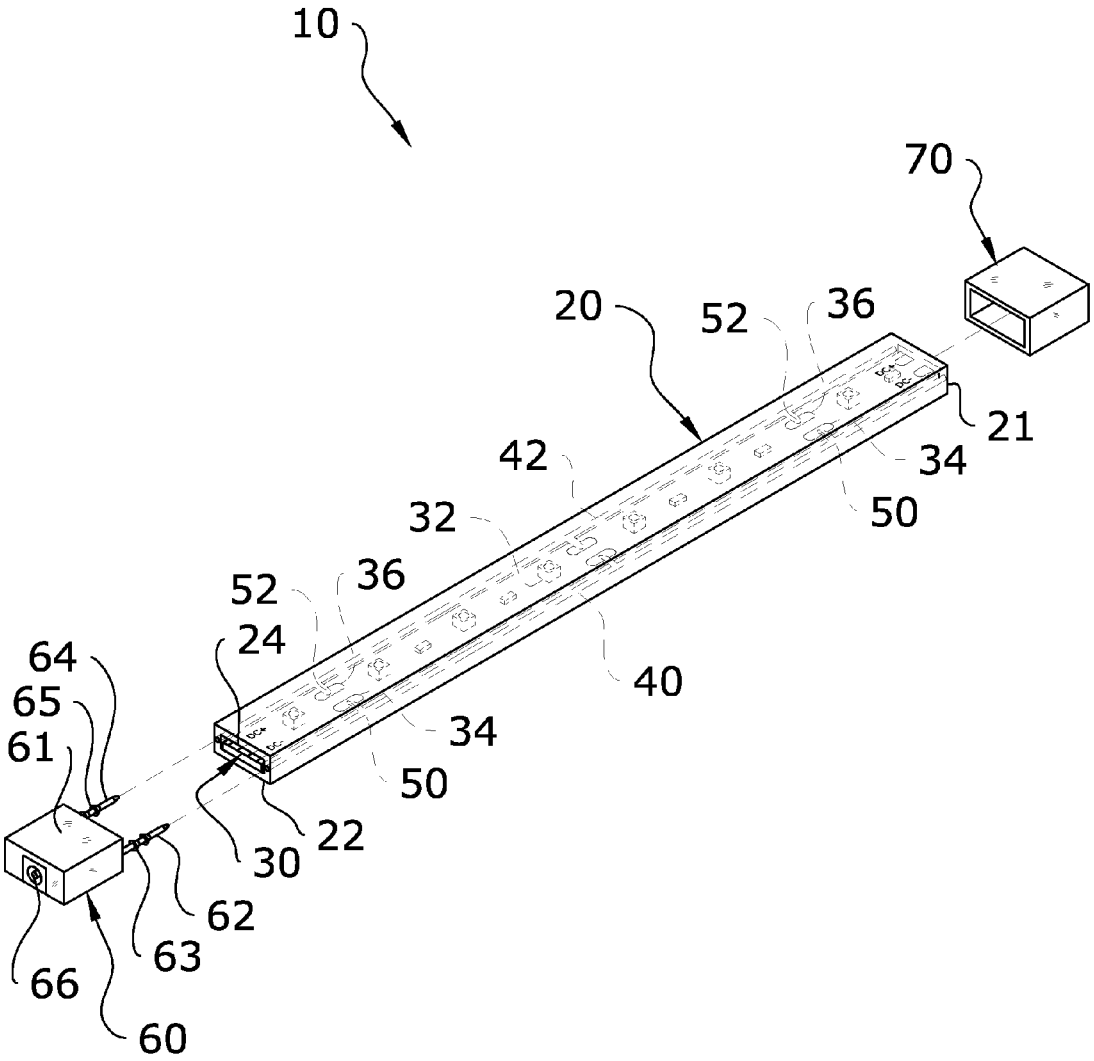
FIG. 2 is an exploded upper perspective view of the present invention with a power coupler and an end connector.

FIG. 2 illustrates a tubular structured end cap 70 that is attached to an end of the protective covering 20 opposite of the power coupler 60 to seal the protective covering 20. The end cap 70 is comprised of a tubular structure with an opening shaped to receive the end of the protective covering 20 and an enclosed end. A sealant (e.g. silicone sealant) or adhesive is preferably applied between the end cap 70 and the protective covering 20 to prevent the entry of water into the passage 24 of the protective covering 20. If the protective covering 20 encapsulates the light strip 30 with no passage 24, then the end may be protected with only sealant applied to the power buses 40, 42, 44, 46 and the light strip 30.

D. Power Buses

A plurality of power buses 40, 42, 44, 46 (e.g. wires) extend within the protective covering 20 and preferably are encapsulated within the protective covering 20 spaced from the light strip 30. The power buses 40, 42, 44, 46 are comprised of electrically conductive material (e.g. metal) that is capable of transmitting significantly more electrical power than the traces of the light strip 30 are capable of transmitting thereby extending the usable length of the light strip 30, particularly when the light strip 30 is comprised of a flexible LED light strip 30. The power buses 40, 42, 44, 46 may be positioned within the passage 24 if surrounded by insulation, however, it is preferable that the power buses 40, 42, 44, 46 are not positioned within or in contact with the passage 24 of the protective covering 20.

As illustrated in FIGS. 1 through 8*b* of the drawings, a first power bus 40 and a second power bus 42 extend within the protective covering 20. As best illustrated in FIGS. 8*a* and 8*b* of the drawings, the first power bus 40 and the second power bus 42 are preferably encapsulated by the protective covering 20 and spaced apart from the light strip 30. The power buses 40, 42, 44, 46 may be encapsulated within the base portion 26, the sidewalls or the outer portion 29 of the protective covering 20, and any combination thereof (e.g. the first power bus 40 may be encapsulated within the first sidewall 27 and the second power bus 42 encapsulated within the second sidewall 28 as illustrated FIG. 8*a*; the first power bus 40 and the second power bus 42 may be encapsulated within the first sidewall 27 with the third power bus 44 and the fourth power bus 46 encapsulated within the second sidewall 28; all of the power buses 40, 42, 44, 46 may be encapsulated within the base portion 26, first sidewall 27, second sidewall 28 or outer portion 29). It is preferable to encapsulate the power buses 40, 42, 44, 46 within the base portion 26 to prevent interference with the light emitted by the light units 32.

The first trace of the light strip 30 is electrically connected to the first power bus 40 at a plurality of spaced apart locations and the second trace of the light strip 30 is electrically connected to the second power bus 42 at a plurality of spaced apart locations. It is preferable that the connection locations between the first bus and the second bus with respect to the first trace and the second trace are in the approximate same distance along the length of the light strip 30.

In particular, a plurality of first connectors 50 electrically connect the first power bus 40 to a corresponding plurality of first contacts 34 electrically connected to the first trace, and a plurality of second connectors 52 electrically connect the second power bus 42 to a corresponding plurality of second contacts 36 electrically connected to the second trace. The first connectors 50 and the second connectors 52 are electrically conductive such as wires. The plurality of first connectors 50 and the plurality of second connectors 52 are preferably equidistantly spaced apart at a distance to ensure a relatively consistent voltage is applied to all of the light units 32 within the light strip 30 (e.g. every 6 inches along the length of the light strip 30).

Figure 10:
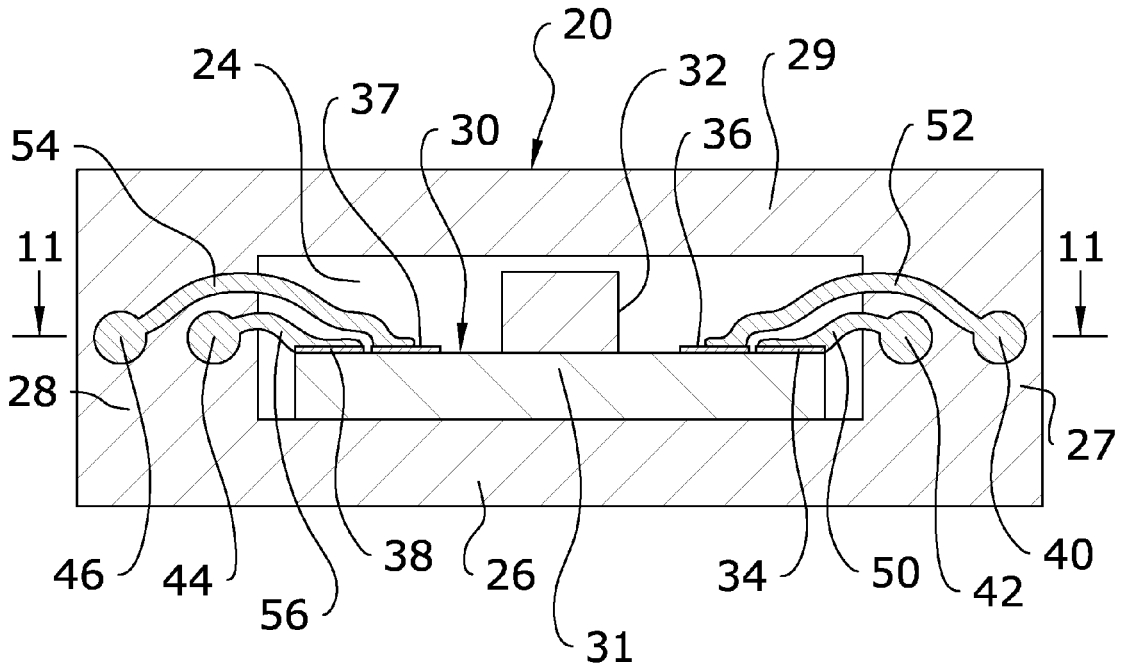
FIG. 10 is a cross sectional view taken along line 10-10 of FIG. 11 showing an alternative embodiment of the present invention having four power buses.
Figure 11:
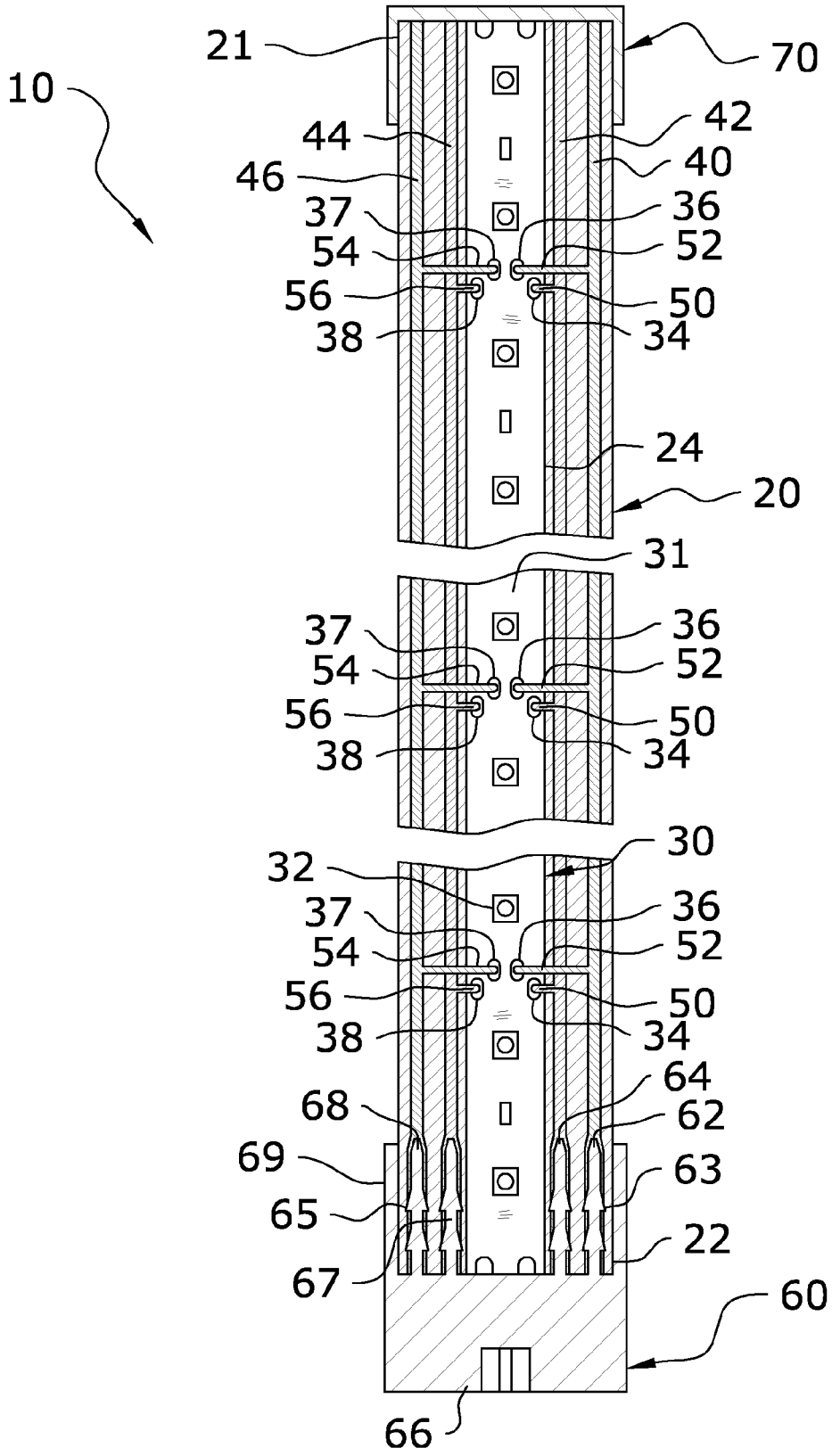
FIG. 11 is a partial cutaway top view of the alternative embodiment of the present invention.
Figure 12:
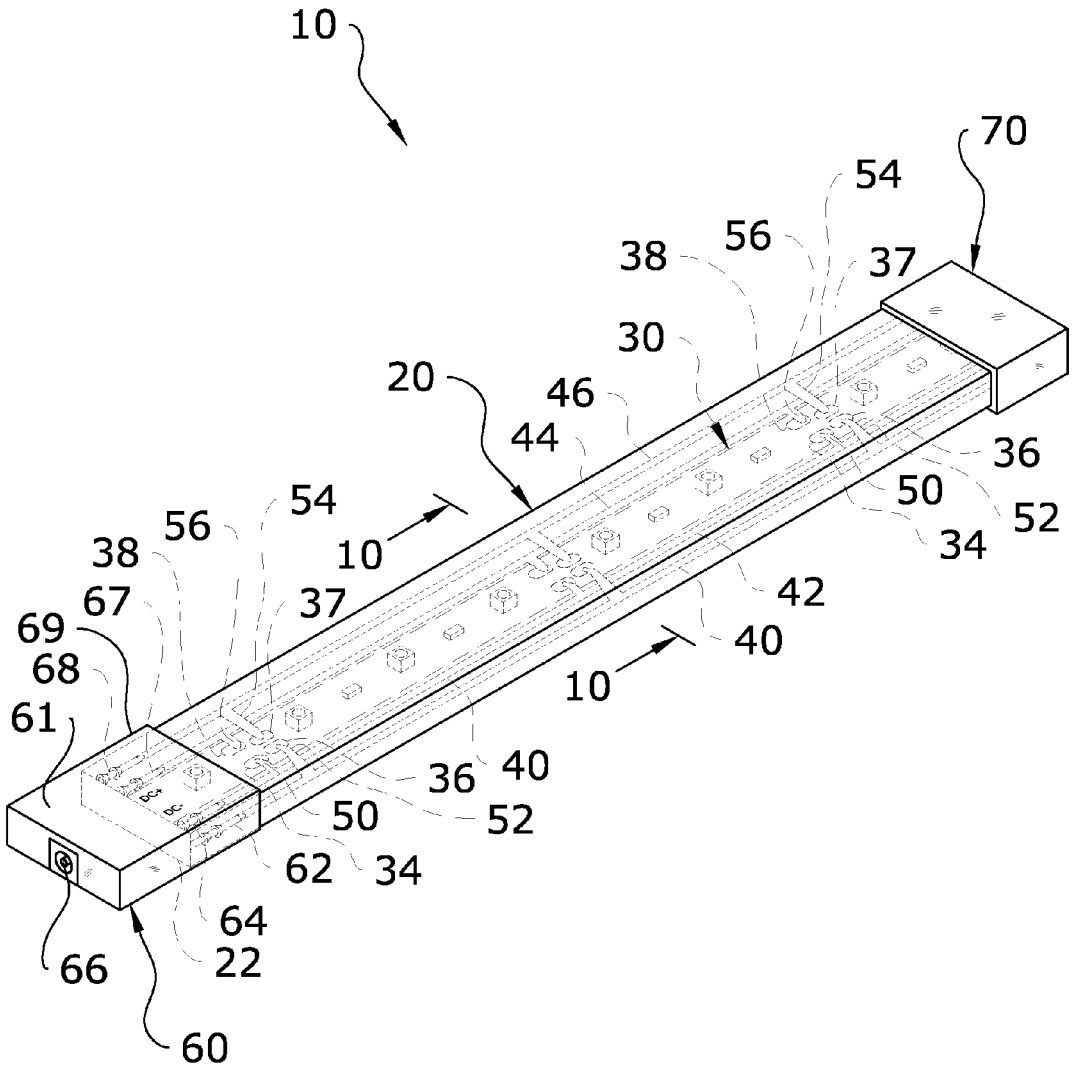
FIG. 12 is an upper perspective view of the alternative embodiment with an extended portion extending from the power coupler and surrounding an end portion of the protective covering.

As illustrated in FIGS. 10 through 12, a third power bus 44 and a fourth power bus 42 may extend within the protective covering 20 when the light strip 30 emits multiple colors. The third power bus 44 is electrically connected to a third trace of the light strip 30 at a plurality of spaced apart locations with a corresponding plurality of third connectors 54 and the fourth power bus 46 is electrically connected to a fourth trace of the light strip 30 with a corresponding plurality of fourth connectors 56 at a plurality of spaced apart locations.

E. Power Coupler

Figure 4:
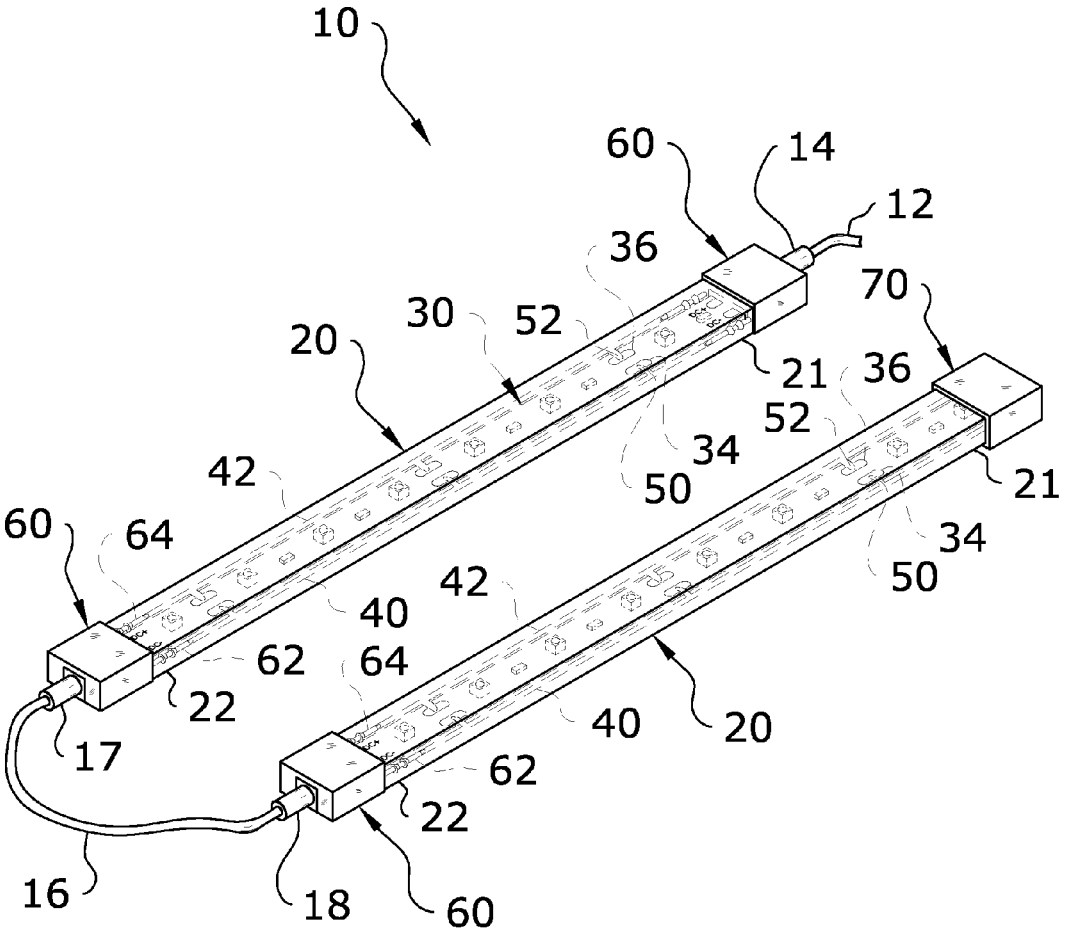
FIG. 4 is an upper perspective view of two flexible LED light strips connected together.
Figure 5:
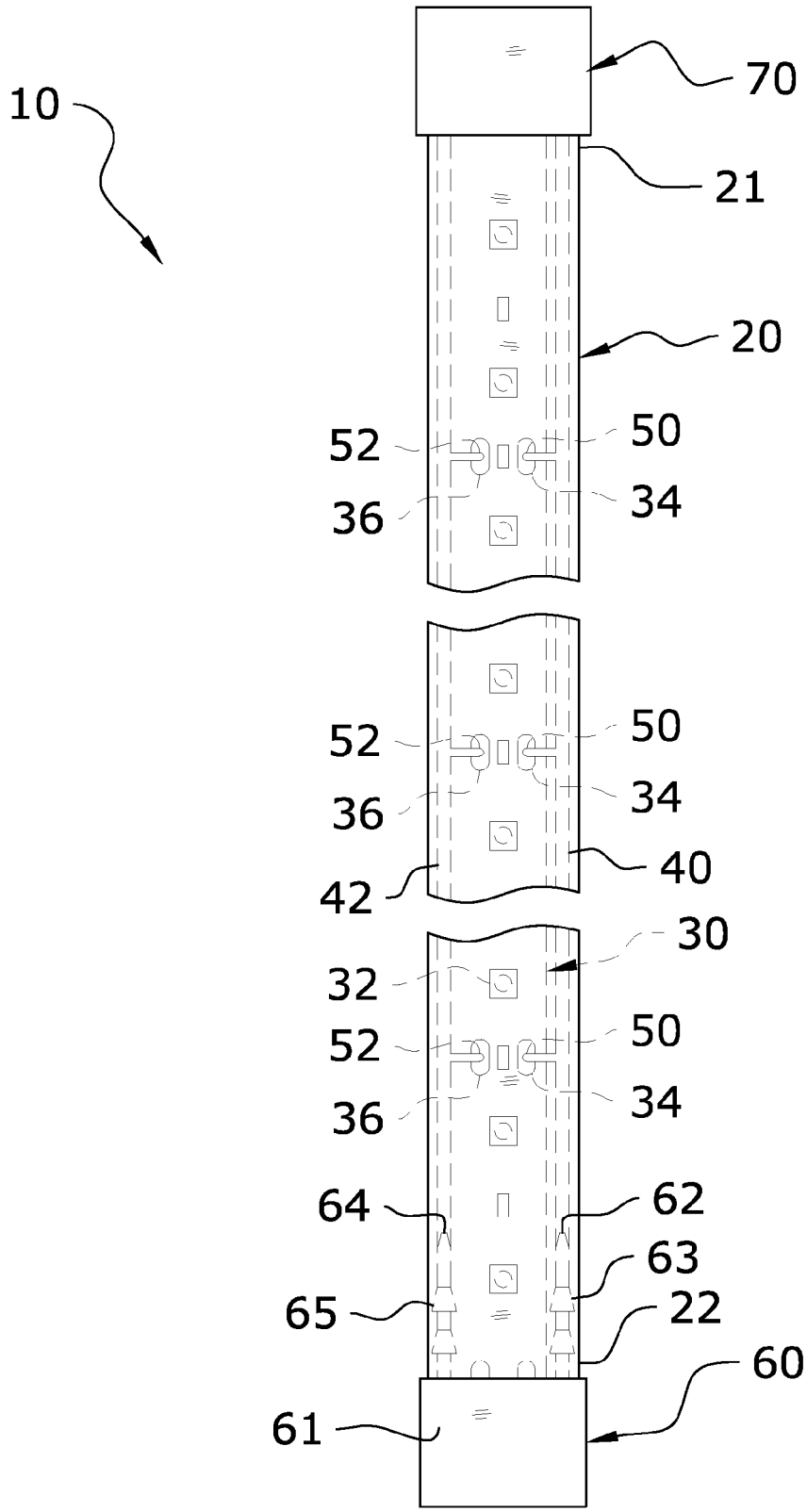
FIG. 5 is a top view of the present invention.

The power coupler 60 includes a first prong 62 and a second prong 64 that extend outwardly from the housing 61 of the power coupler 60. The first prong 62 and the second prong 64 are preferably parallel with respect to one another and extend outwardly at least 0.2 inches from the housing 61. The first prong 62 and the second prong 64 are comprised of electrically conductive material (e.g. metal) that are electrically connected to the power receptacle 66 within the housing 61. The power receptacle 66 receives a main power connector 14 from a power cable 12, wherein the power cable 12 is electrically connected to a DC power source (e.g. batteries, AC/DC converter). It is preferable that the DC power source provides 12V DC electric power, however, the DC voltage provided may be greater or less than 12V DC. FIG. 4 illustrates a connector cable 16 that includes a first power connector 17 and a second power connector 18 for electrically coupling two power couplers 60 together from two different lighting strips.

The power coupler 60 is attached to an end of the protective covering 20 to electrically communicate with the power buses 40, 42, 44, 46 and to seal the end of the protective covering 20. Sealant or adhesive may be utilized to connect the power coupler 60 in a sealed manner with respect to the protective covering 20 to prevent the entry of water into the passage 24 or otherwise making contact with the light strip 30.

Figure 3:
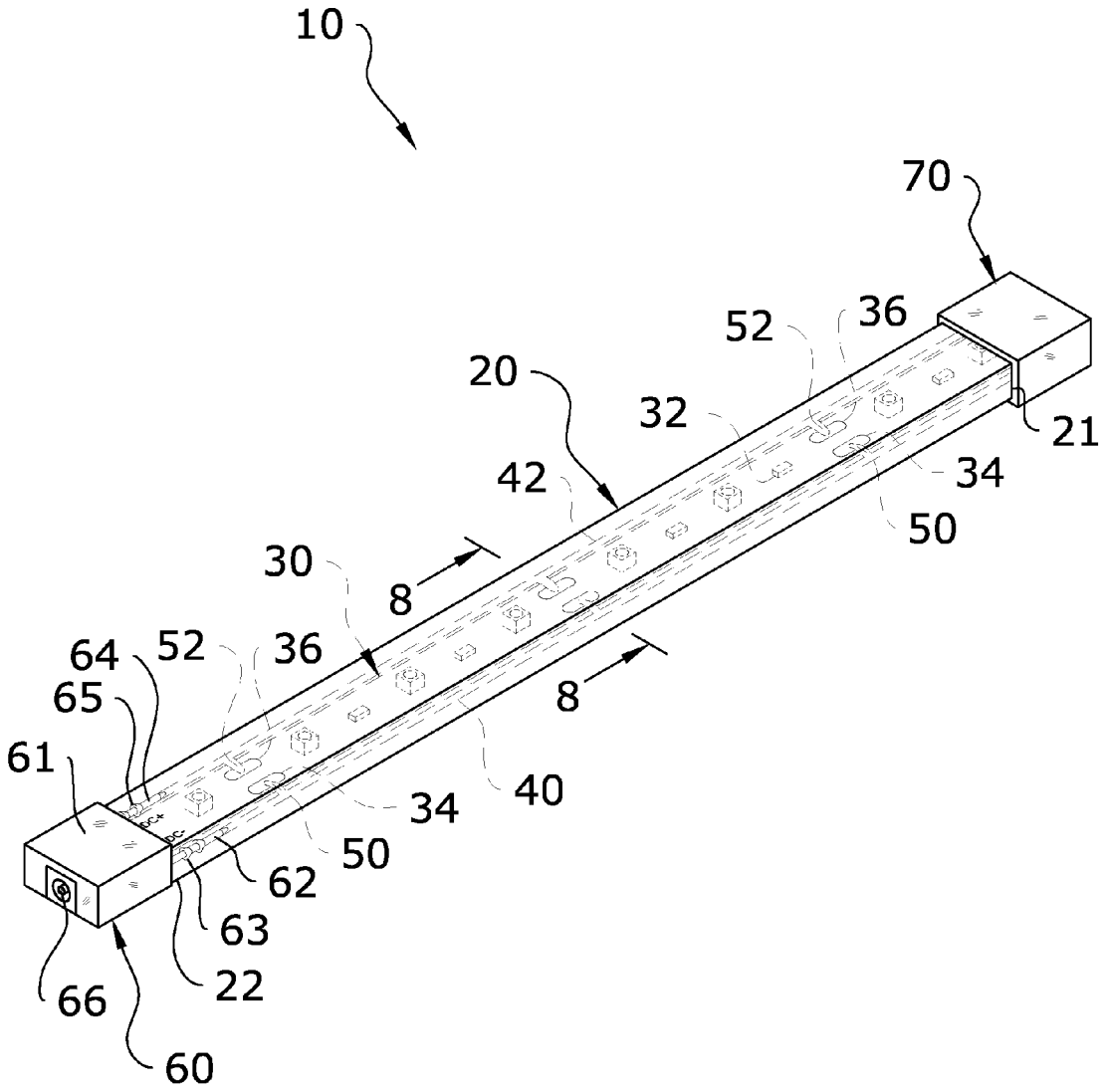
FIG. 3 is an upper perspective view of the present invention with a power coupler and an end connector attached to the ends thereof.

The first prong 62 and the second prong 64 extend into the protective covering 20 to directly and electrically connect to the first power bus 40 and the second power bus 42 respectively as best illustrated in FIGS. 3 and 6 of the drawings. The prongs 62, 64, 67, 68 include a tapered distal end that is pointed for penetrating the protective covering 20 and the power buses 40, 42, 44, 46. The prongs 62, 64, 67, 68 further include barbs to prevent the removable of the power coupler 60 from the protective covering 20 as illustrated by the first barbs 63 extending from the first prong 62 and the second barbs 65 extending from the second prong 64. The bars are preferably comprised of a cincture structure that tapers outwardly from front to back. With respect to when four power buses 40, 42, 44, 46 are utilized within the protective covering 20, the power coupler 60 includes a third prong 67 and a fourth prong 68 with respective barbs. The prongs 62, 64, 67, 68 are aligned with the power buses 40, 42, 44, 46 and preferably substantially concentric with respect to the same to ensure a quality electrical connection as illustrated in FIGS. 6 and 11 of the drawings.

The power coupler 60 preferably includes an extended tubular portion 69 that extends outwardly from the housing 61 and surrounds the prongs 62, 64, 67, 68. The extended tubular portion 69 receives and surrounds the end of the protective covering 20 to assist in maintaining a physical connection between the power coupler 60 and the protective covering 20. The extended tubular portion 69 also prevents water from entering into the passage 24 of the protective covering 20 or otherwise making contact with the light strip 30. Sealant or adhesive are preferably applied between the extended tubular portion 69 and the protective covering 20 to seal and secure the same.

Figure 9A:
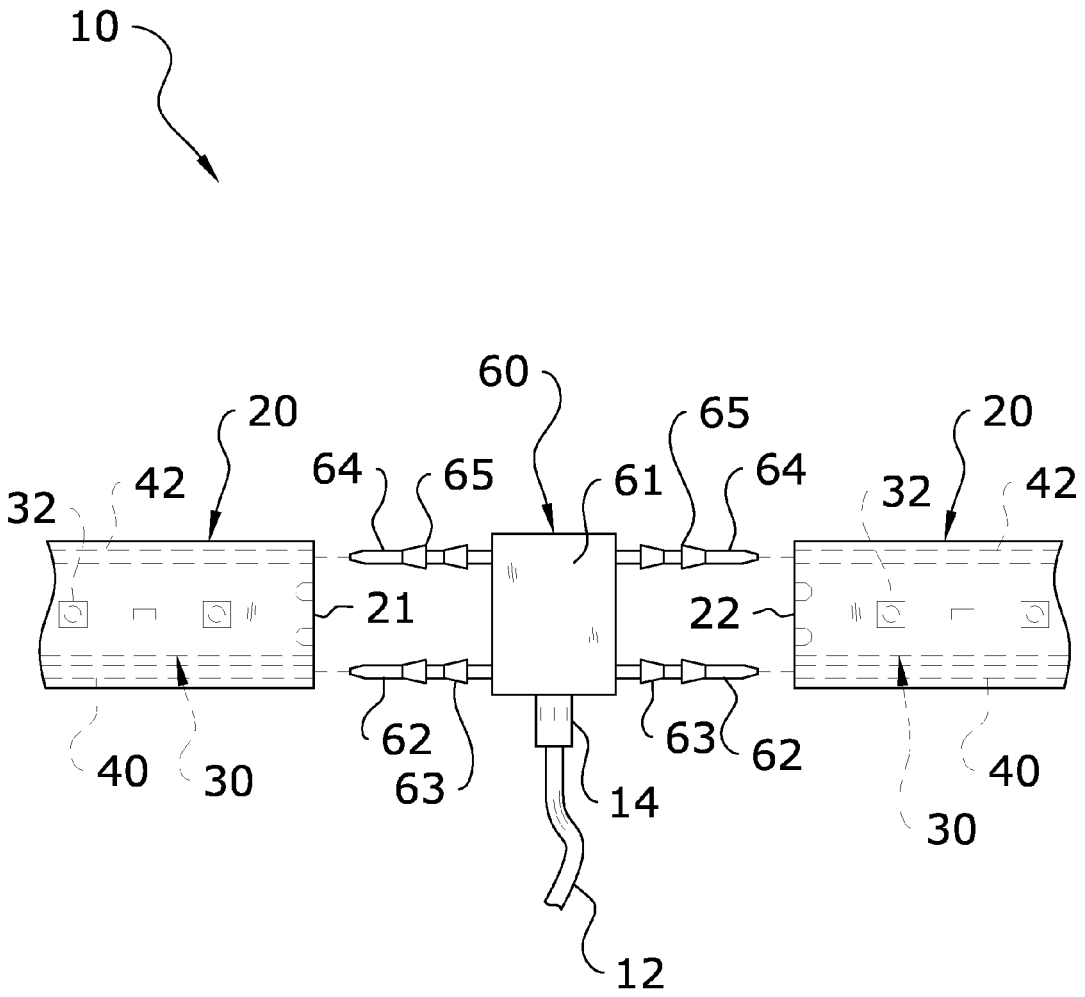
FIG. 9*a* is an exploded top view of an alternative power coupler having two sets of prongs for connecting adjacent light strips.
Figure 9B:
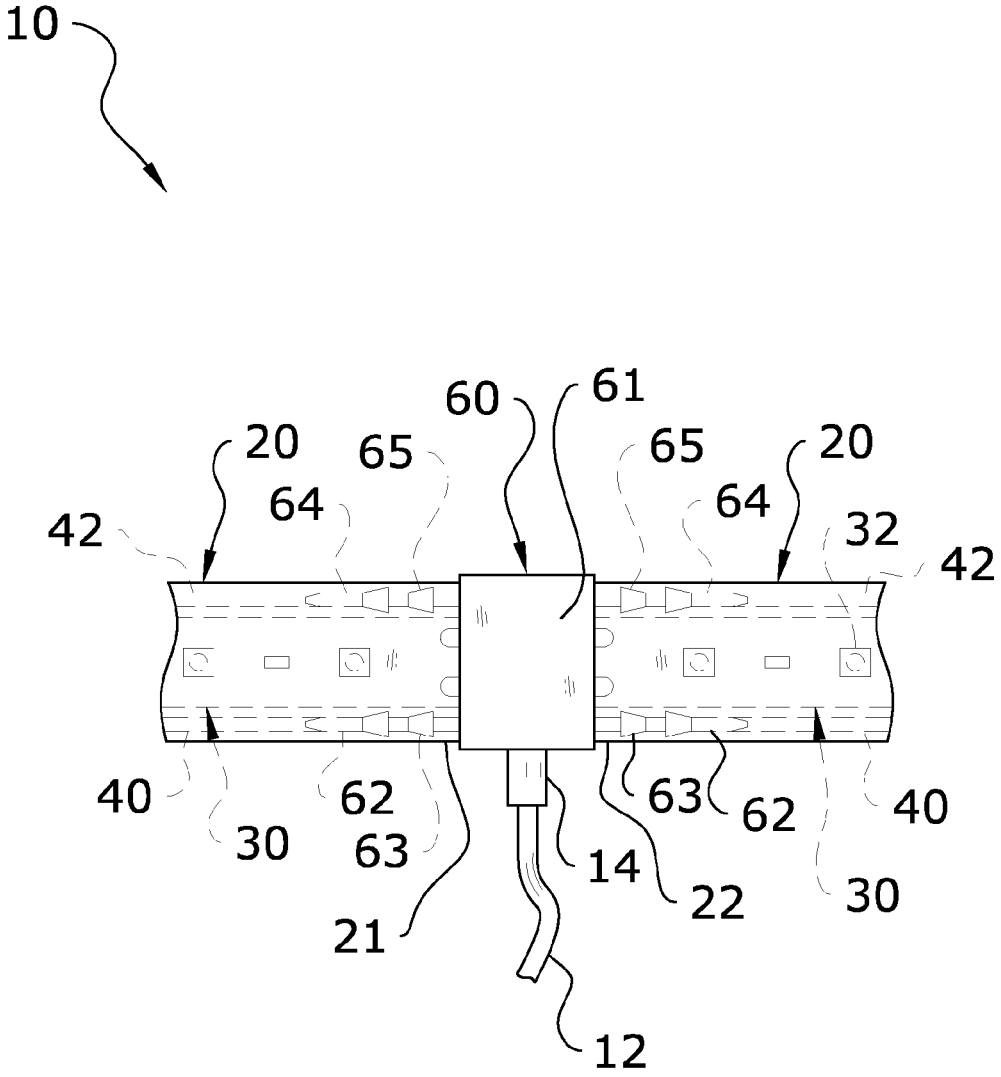
FIG. 9*b* is a top view of the alternative power coupler.

FIGS. 9*a* and 9*b* illustrate an alternative power coupler 60 having two sets of a first prong 62 and a second prong 64 extending from the housing 61 to provide electrical power to two different lighting strips. It can be appreciated that a third set of prongs may also be attached to the power coupler 60.

Figure 13:
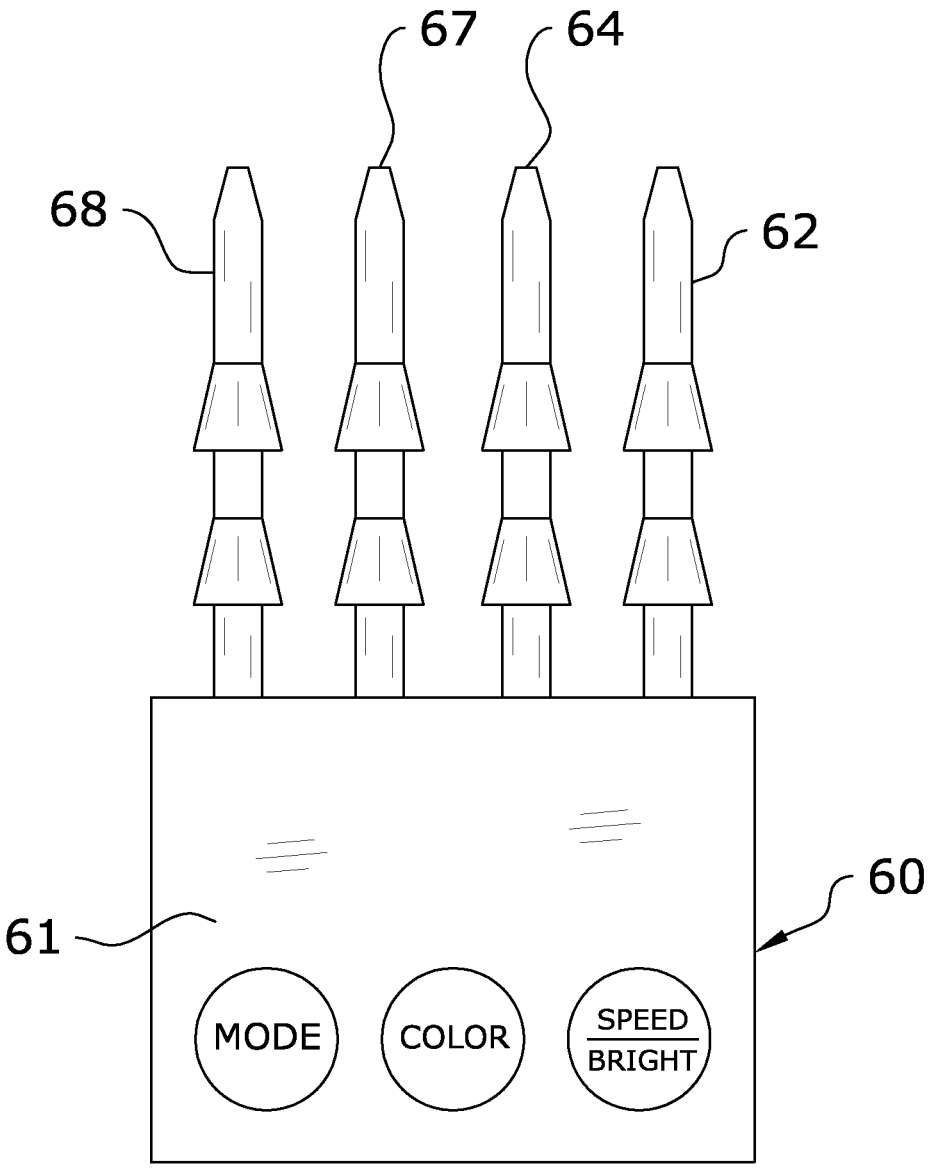
FIG. 13 is a top view of a power coupler with control circuitry included for controlling the operation of the light strip.
Figure 14:
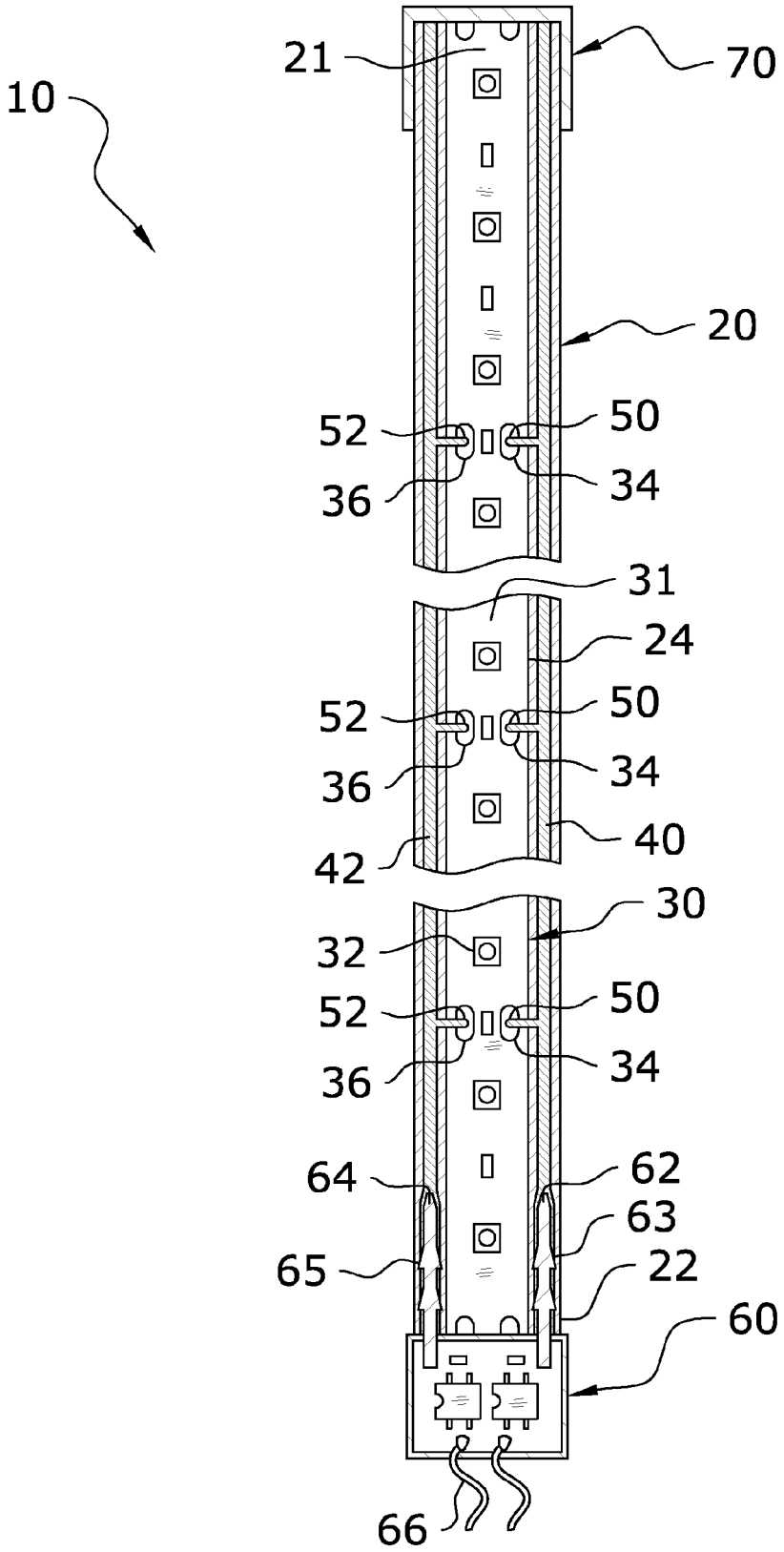
FIG. 14 is a partial cutaway top view of the power coupler connected to the protective covering wherein said power coupler includes a printed circuit board (PCB) with a pair of electrical power wires directly connected to the PCB to provide electrical power to the PCB.
Figure 15:
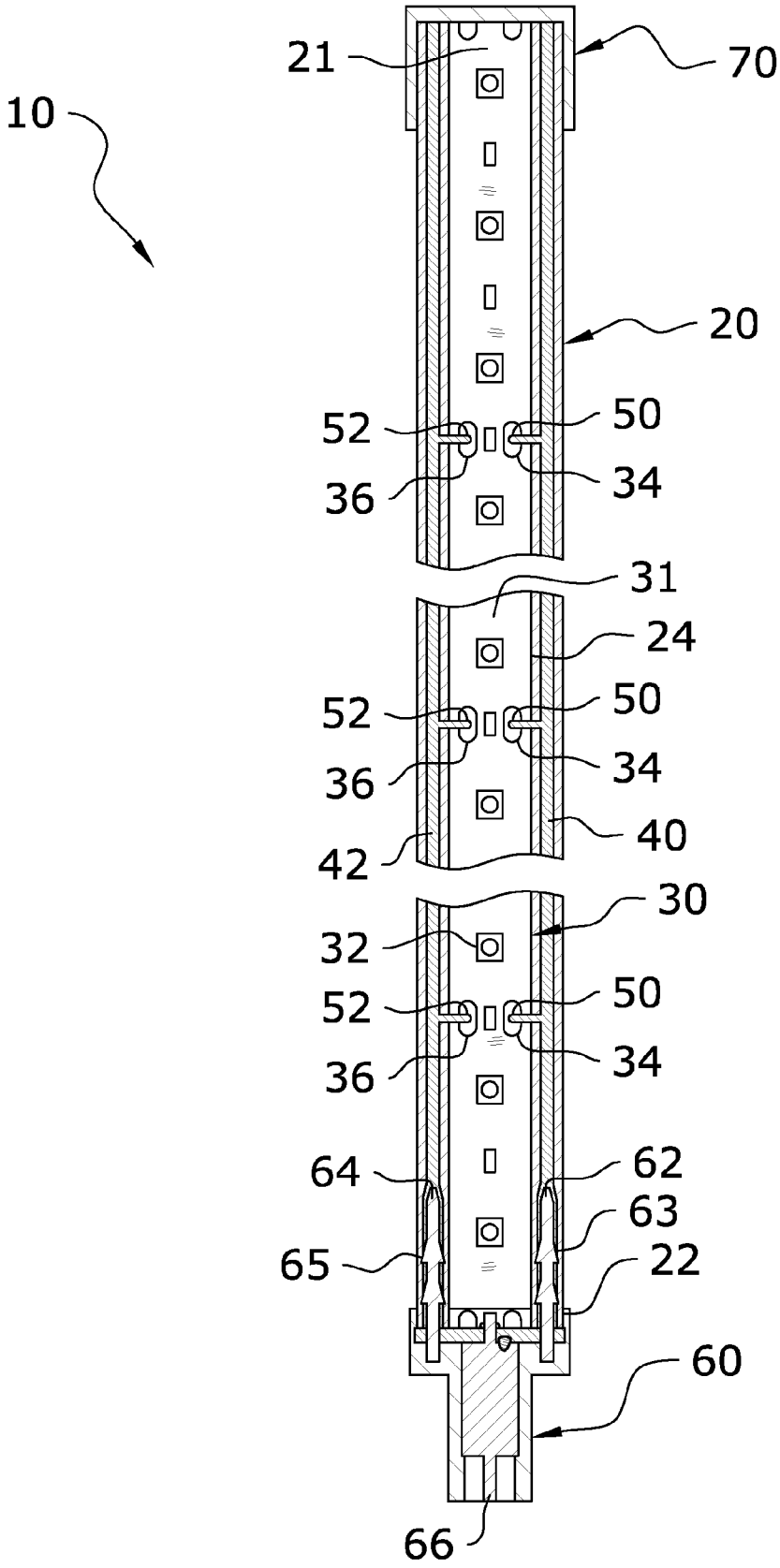
FIG. 15 is a partial cutaway top view of the power coupler connected to the protective covering wherein said power coupler includes a printed circuit board (PCB) with a power receptacle connected to the PCB.
Figure 16:
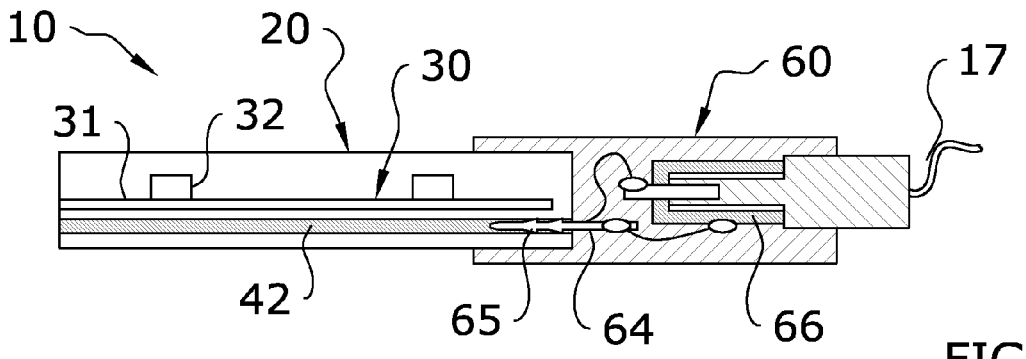
FIG. 16 is a side cutaway view of the power coupler connected to the protective covering and electrically connected to the power buses wherein the power coupler is comprised of an overmolded PCB or components assembled in a jig along with a first power coupler connected within the power receptacle in a sealed manner to prevent the entry of water into the power receptacle.
Figure 17:
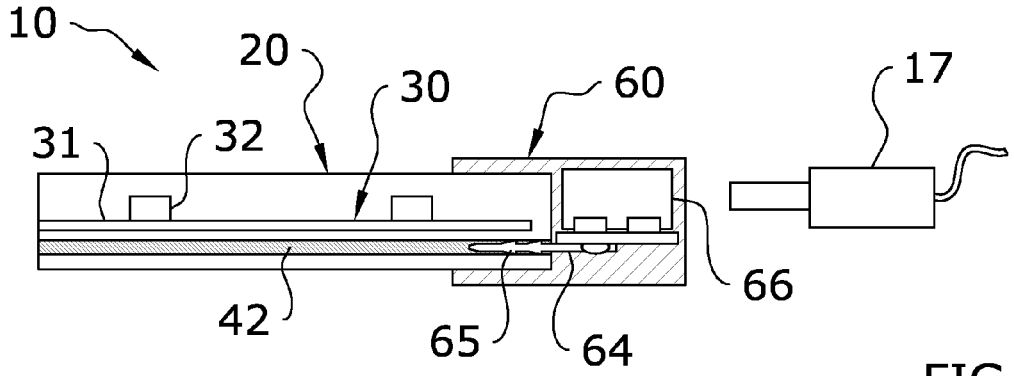
FIG. 17 is a side cutaway view of the power coupler with a PCB having a protective cover.
Figure 18:
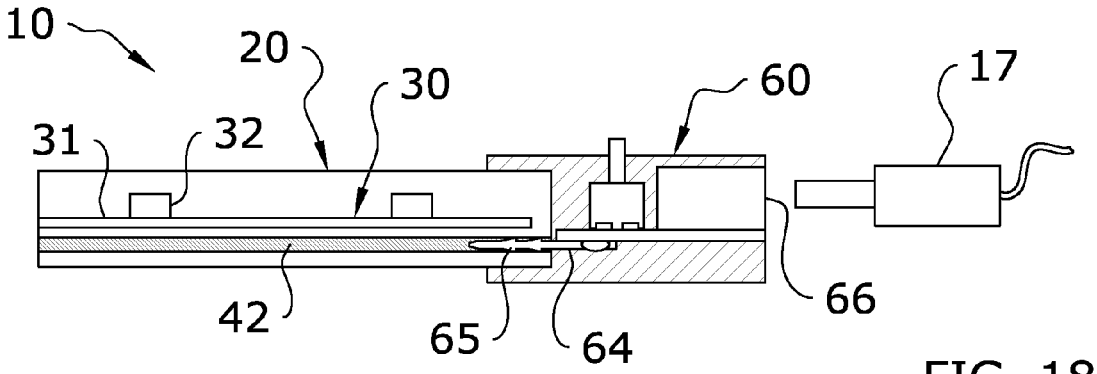
FIG. 18 is a side cutaway view of the power coupler with a smart PCB with components on the PCB with a cover.

FIG. 13 illustrates an embodiment of the power coupler 60 that includes a control unit with buttons that allows for controlling the colors and light patterns emitted by the light strip 30. In addition, the power coupler 60 may include system level components within a printed circuit board such as but not limited to occupancy sensors, timers, dimmers, switches, diode bridges, voltage regulators and control modules. FIG. 14 is a partial cutaway top view of the power coupler connected to the protective covering wherein said power coupler includes a printed circuit board (PCB) with a pair of electrical power wires directly connected to the PCB to provide electrical power to the PCB. FIG. 15 is a partial cutaway top view of the power coupler connected to the protective covering wherein said power coupler includes a printed circuit board (PCB) with a power receptacle connected to the PCB. FIG. 16 is a side cutaway view of the power coupler connected to the protective covering and electrically connected to the power buses wherein the power coupler is comprised of an overmolded PCB or components assembled in a jig along with a first power coupler connected within the power receptacle in a sealed manner to prevent the entry of water into the power receptacle. FIG. 17 is a side cutaway view of the power coupler with a PCB having a protective cover. FIG. 18 is a side cutaway view of the power coupler with a smart PCB with components on the PCB with a cover.

E. Operation of Preferred Embodiment

In use, the user is provided with a length of the lighting strip comprised of the light strip 30 within the protective covering 20 such as in a spool or roll as illustrated in FIG. 1 of the drawings. The user selects the length of the lighting strip they need (e.g. 50 feet) and then cuts the lighting strip to the desired length. The user connects the power coupler 60 to the first end 22 of the lighting strip by penetrating the prongs 62, 64, 67, 68 into the protective covering 20 in the locations of the power buses 40, 42, 44, 46 and thereby penetrating the power buses 40, 42, 44, 46 as illustrated in FIGS. 6 and 11 of the drawings. Sealant or adhesive may be applied before or after to provide a waterproof seal between the power coupler 60 and the lighting strip. The user then secures the end cap 70 with adhesive or sealant to the second end 21 of the protective housing 61 to seal and protect the lighting strip. A DC power supply is electrically connected to the power coupler 60 to provide electrical power to the power buses 40, 42, 44, 46 and the light strip 30 wherein the light units 32 illuminate.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A light strip system, comprising:

a light strip having a first trace and a second trace extending along a length of said light strip, wherein said light strip is comprised of a low voltage light strip adapted to be electrically powered by a DC power supply, wherein said DC power supply has a voltage output of 48V DC or less;

a protective covering surrounding said light strip, wherein said protective covering is comprised of a flexible material;

a first power bus extending within said protective covering; and a second power bus extending within said protective covering;

wherein said first trace is electrically connected to said first power bus at a plurality of spaced apart locations and wherein said second trace is electrically connected to said second power bus at a plurality of spaced apart locations;

wherein said protective covering includes a passage extending longitudinally along the length of said protective covering;

wherein said light strip is positioned within said passage;

wherein said first power bus and said second power bus are both encapsulated within said protective covering.

2. The light strip system of claim 1, wherein said light strip is comprised of a flexible LED light strip.

3. The light strip system of claim 2, wherein said flexible LED light strip and said protective covering are at least 40 feet in length.

4. The light strip system of claim 1, including a plurality of first connectors electrically connecting said first power bus and said first trace, and a plurality of second connectors electrically connecting said second power bus and said second trace.

5. The light strip system of claim 4, wherein said plurality of first connectors are equidistantly spaced.

6. The light strip system of claim 1, including a third power bus extending within said protective covering and a fourth power bus extending within said protective covering, wherein said third power bus is electrically connected to a third trace of said light strip at a plurality of spaced apart locations and wherein said fourth power bus is electrically connected to a fourth trace of said light strip at a plurality of spaced apart locations.

7. The light strip system of claim 6, including a power coupler attached to an end of said protective covering and electrically connected to said power buses, wherein said power coupler includes a first prong, a second prong, a third prong and a fourth prong, wherein said prongs extend into said protective covering to electrically connect to said power buses respectively.

8. The light strip system of claim 7, wherein said prongs each include a plurality of barbs.

9. The light strip system of claim 1, wherein said first power bus and said second power bus are not positioned within said passage.

10. The light strip system of claim 1, wherein said protective covering includes a base portion and wherein said first power bus and said second power bus are both encapsulated within said base portion.

11. The light strip system of claim 1, wherein said protective covering includes a base portion, a first sidewall, a second sidewall and an outer portion forming a rectangular cross shaped structure, and wherein said first power bus is encapsulated within said first sidewall and said second power bus is encapsulated within said second sidewall.

12. The light strip system of claim 1, including an end cap attached to an end of said protective covering.

13. The light strip system of claim 1, including a power coupler attached to an end of said protective covering and electrically connected to said first power bus and said second power bus.

14. The light strip system of claim 13, wherein said power coupler includes a first prong and a second prong, wherein said first prong and said second prong extend into said protective covering to electrically connect to said first power bus and said second power bus respectively.

15. The light strip system of claim 14, wherein said first prong includes a plurality of first barbs and wherein said second prong includes a plurality of second barbs.

16. The light strip system of claim 13, wherein said power coupler is electrically connected to a 12 volt DC power supply.

17. The light strip system of claim 1, including a power coupler attached to an end of said protective covering and electrically connected to said first power bus and said second power bus, wherein said power coupler includes an extended tubular portion that receives and surrounds said end of said protective covering.

18. A light strip system, comprising:

a light strip having a first trace and a second trace extending along a length of said light strip, wherein said light strip is comprised of a low voltage light strip adapted to be electrically powered by a DC power supply, wherein said DC power supply has a voltage output of 48V DC or less;

a protective covering surrounding said light strip, wherein said protective covering is comprised of a flexible material;

a first power bus extending within said protective covering; and a second power bus extending within said protective covering;

wherein said first trace is electrically connected to said first power bus at a plurality of spaced apart locations and wherein said second trace is electrically connected to said second power bus at a plurality of spaced apart locations;

wherein said protective covering includes a passage extending longitudinally along the length of said protective covering;

wherein said light strip is positioned within said passage;

wherein said protective covering includes a base portion and wherein said first power bus and said second power bus are both encapsulated within said base portion.

19. A light strip system, comprising:

a light strip having a first trace and a second trace extending along a length of said light strip, wherein said light strip is comprised of a low voltage light strip adapted to be electrically powered by a DC power supply, wherein said DC power supply has a voltage output of 48V DC or less;

a protective covering surrounding said light strip, wherein said protective covering is comprised of a flexible material;

a first power bus extending within said protective covering; and a second power bus extending within said protective covering;

wherein said first trace is electrically connected to said first power bus at a plurality of spaced apart locations and wherein said second trace is electrically connected to said second power bus at a plurality of spaced apart locations;

wherein said protective covering includes a passage extending longitudinally along the length of said protective covering;

wherein said light strip is positioned within said passage;

wherein said protective covering includes a base portion, a first sidewall, a second sidewall and an outer portion forming a rectangular cross shaped structure, and wherein said first power bus is encapsulated within said first sidewall and said second power bus is encapsulated within said second sidewall.

20. A light strip system, comprising:

a light strip having a first trace and a second trace extending along a length of said light strip, wherein said light strip is comprised of a low voltage light strip adapted to be electrically powered by a DC power supply, wherein said DC power supply has a voltage output of 48V DC or less;

a protective covering surrounding said light strip, wherein said protective covering is comprised of a flexible material;

a first power bus extending within said protective covering; and a second power bus extending within said protective covering;

wherein said first trace is electrically connected to said first power bus at a plurality of spaced apart locations and wherein said second trace is electrically connected to said second power bus at a plurality of spaced apart locations;

a power coupler attached to an end of said protective covering and electrically connected to said first power bus and said second power bus, wherein said power coupler includes a first prong and a second prong, wherein said first prong and said second prong extend into said protective covering to electrically connect to said first power bus and said second power bus respectively.

21. A light strip system, comprising:

a light strip having a first trace and a second trace extending along a length of said light strip, wherein said light strip is comprised of a low voltage light strip adapted to be electrically powered by a DC power supply, wherein said DC power supply has a voltage output of 48V DC or less;

a protective covering surrounding said light strip, wherein said protective covering is comprised of a flexible material;

a first power bus extending within said protective covering; and a second power bus extending within said protective covering;

wherein said first trace is electrically connected to said first power bus at a plurality of spaced apart locations and wherein said second trace is electrically connected to said second power bus at a plurality of spaced apart locations;

a third power bus extending within said protective covering and a fourth power bus extending within said protective covering, wherein said third power bus is electrically connected to a third trace of said light strip at a plurality of spaced apart locations and wherein said fourth power bus is electrically connected to a fourth trace of said light strip at a plurality of spaced apart locations.

* * * * *